US009486689B2

(12) United States Patent
Hooper

(10) Patent No.: US 9,486,689 B2
(45) Date of Patent: Nov. 8, 2016

(54) GOLF PRACTICE MAT MODULES AND ASSEMBLY

(71) Applicant: FIBERBUILT MANUFACTURING INC., Calgary (CA)

(72) Inventor: Michael Hooper, Chestermere (CA)

(73) Assignee: FIBERBUILT MANUFACTURING INC., Calgary (CA)

( * ) Notice: Subject to any disclaimer, the term of this patent is extended or adjusted under 35 U.S.C. 154(b) by 0 days.

(21) Appl. No.: 14/828,943

(22) Filed: Aug. 18, 2015

(65) Prior Publication Data

US 2016/0045805 A1 Feb. 18, 2016

Related U.S. Application Data

(60) Provisional application No. 62/038,715, filed on Aug. 18, 2014.

(51) Int. Cl.
*A63B 69/36* (2006.01)
*A63B 71/00* (2006.01)

(52) U.S. Cl.
CPC ..... *A63B 69/3661* (2013.01); *A63B 57/20* (2015.10); *A63B 71/0045* (2013.01); *A63B 2225/09* (2013.01)

(58) Field of Classification Search
USPC ..... 473/178, 179, 409
See application file for complete search history.

(56) References Cited

U.S. PATENT DOCUMENTS

| | | | | | |
|---|---|---|---|---|---|
| 2,879,996 | A * | 3/1959 | Lederer | A63B 69/3652 | 248/182.1 |
| 4,620,998 | A * | 11/1986 | Lalvani | B44C 3/123 | 273/157 R |
| 5,002,280 | A * | 3/1991 | Hines | A63B 67/02 | 206/315.1 |
| 5,292,130 | A * | 3/1994 | Hooper | A63B 69/3661 | 15/216 |
| 5,888,147 | A * | 3/1999 | Luedtke | A63B 69/3661 | 473/278 |
| 6,450,895 | B1 * | 9/2002 | Galluzzo, Jr. | A63B 69/3652 | 473/279 |
| 7,946,935 | B2 | 5/2011 | Hooper | | |
| 8,147,347 | B2 | 4/2012 | Hooper | | |
| 2007/0042829 | A1 * | 2/2007 | Dennesen | A63B 69/3676 | 473/162 |

* cited by examiner

*Primary Examiner* — Nini Legesse
(74) *Attorney, Agent, or Firm* — Bennett Jones LLP

(57) ABSTRACT

A golf practice mat assembly and a method for constructing a golf practice range is provided. The golf practice mat assembly comprising; a stance section with a first end, a second end, positioned opposite the first end, a front lengthwise side extending between the first end and the second end and a second lengthwise side extending between the first end and the second end; a strike section including a first side and an opposite side; a connection between the stance section and the strike section, the connection configured to securely and detachably connect the strike section to the stance section and the connection further configured to be angularly selectable and to connect the strike section at one of a plurality of possible angular orientations relative to the stance section.

11 Claims, 13 Drawing Sheets

GOLF PRACTICE MAT MODULES AND ASSEMBLY

FIELD

The present invention relates to modules for assembly golf practice mat assembly.

BACKGROUND

Golf practice mats are used by golfers to practice their swings. Many forms of practice mats are available. In general a golf practice mat includes a surface on which a ball can be placed ("strike section"). Some mats also are extended to include a place for a golfer to stand ("stance section"). The surface generally is formed to be durable to withstand repeated club strikes and often is formed to simulate a natural ground surface such as short or long grass.

Dimensionally, the mat is usually square or rectangular in shape, perhaps about five feet by five feet, in order to freely accommodate the user while assuming a practice position standing on the mat. The strike section and the stance section are usually permanently connected together. Due to this permanent connection and the rectangular or square shape of conventional golf mats, the ability to flexibly interconnect a series of golf mats and to customize the configuration of one or a series of golf mats is limited. This is particularly troublesome in driving ranges that seek to have the golf practice mats set up in a non-linear, for example curved, manner. In some practice facilities it is necessary to have the golf practice mats arranged along a curved hitting area so that the balls hit therefrom tend to land in a centralized collection area.

SUMMARY

In accordance with an aspect of the present invention, there is provided a golf practice mat assembly comprising: a stance section with a first end, a second end, positioned opposite the first end, a front lengthwise side extending between the first end and the second end and a second lengthwise side extending between the first end and the second end; a strike section including a first side and an opposite side; a connection between the stance section and the strike section, the connection configured to securely and detachably connect the strike section to the stance section and the connection further configured to be angularly selectable and to connect the strike section at one of a plurality of possible angular orientations relative to the stance section.

In accordance with an aspect of the present invention, there is provided a method for constructing a golf practice range comprising: positioning a first golf practise mat assembly including a first stance section with a first end, a second end, positioned opposite the first end, and a first lengthwise axis passing through a center point on the first end and the second end; and a first strike section connected to the first stance section; positioning a second golf practise mat assembly adjacent to the first golf practise mat assembly, the second golf practise mat assembly including a second stance section with a second lengthwise axis passing through opposite ends of the second stance section; and a second strike section connected to the second stance section; and forming a connection between the first golf practise mat assembly and the second golf practise mat assembly by connecting a connector on a curved edge of the first golf practise mat assembly at one possible angular orientation to a mating curved edge on the second golf practise mat assembly such that the first lengthwise axis is angularly offset from the second lengthwise axis.

BRIEF DESCRIPTION OF THE DRAWINGS

Referring to the drawings, several aspects of the present invention are illustrated by way of example, and not by way of limitation, in detail in the figures, wherein.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The present invention relates to modules for assembling a golf practice mat and a golf practice mat assembly with modular components, which allow for flexible and customizable configuration of a golf practice mat and/or configuration and interconnection of a series of golf practice mats. The modular components can be connected in a non-linear arrangement and, in particular, one module can be connected to an adjacent module in one of a plurality of possible angular orientations. This permits a golf practice mat assembly and, in fact, a series of connected golf practice mats to be placed in a curved configuration. Thus, a golf practice facility with a curved hitting area can have mats installed that are connected to match the curve of the facility and appear custom, but without the price of a custom installation.

Figure 1A:
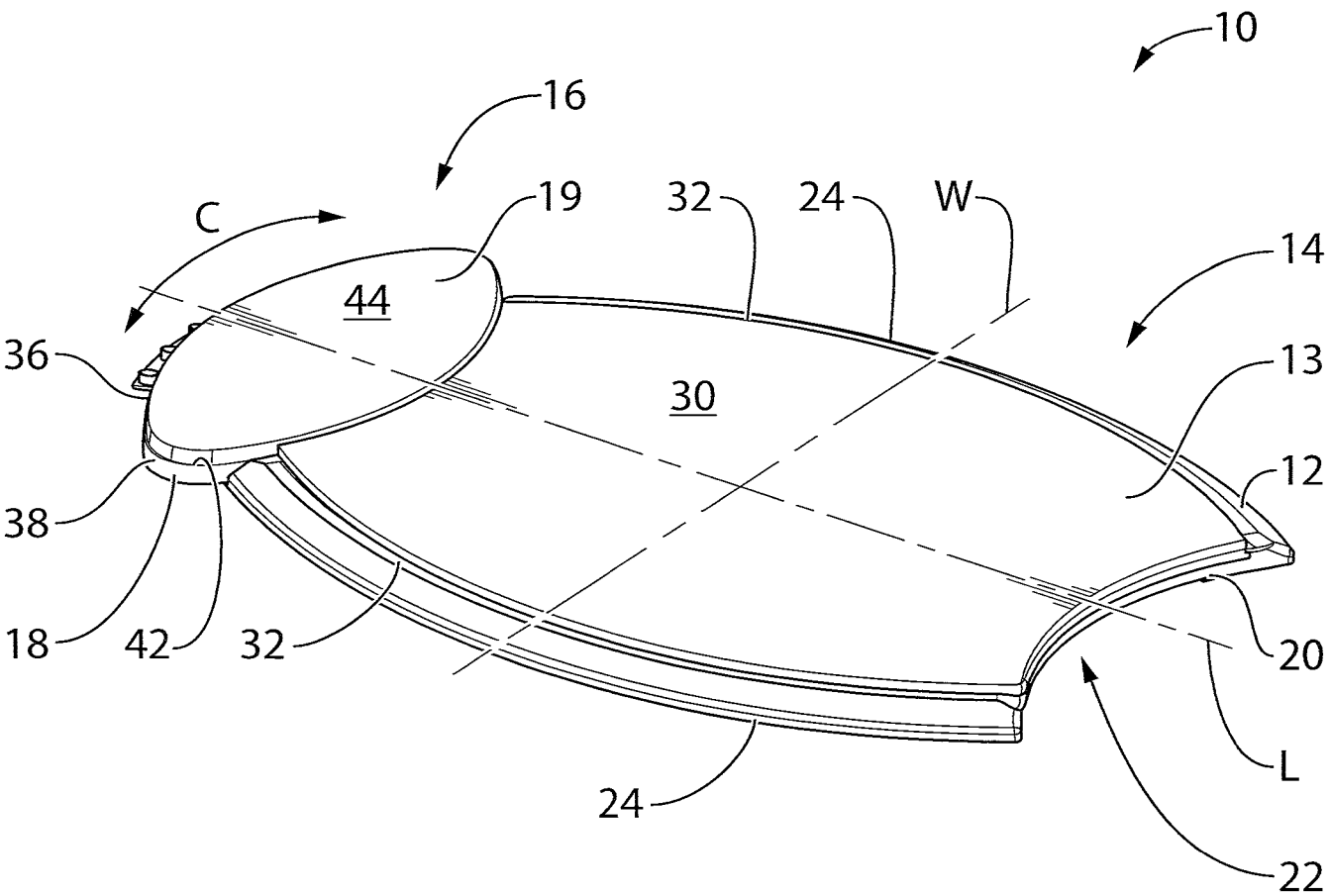
FIG. 1*a* is a perspective view of a golf practice mat assembly according to one embodiment of the present invention.
Figure 1B:
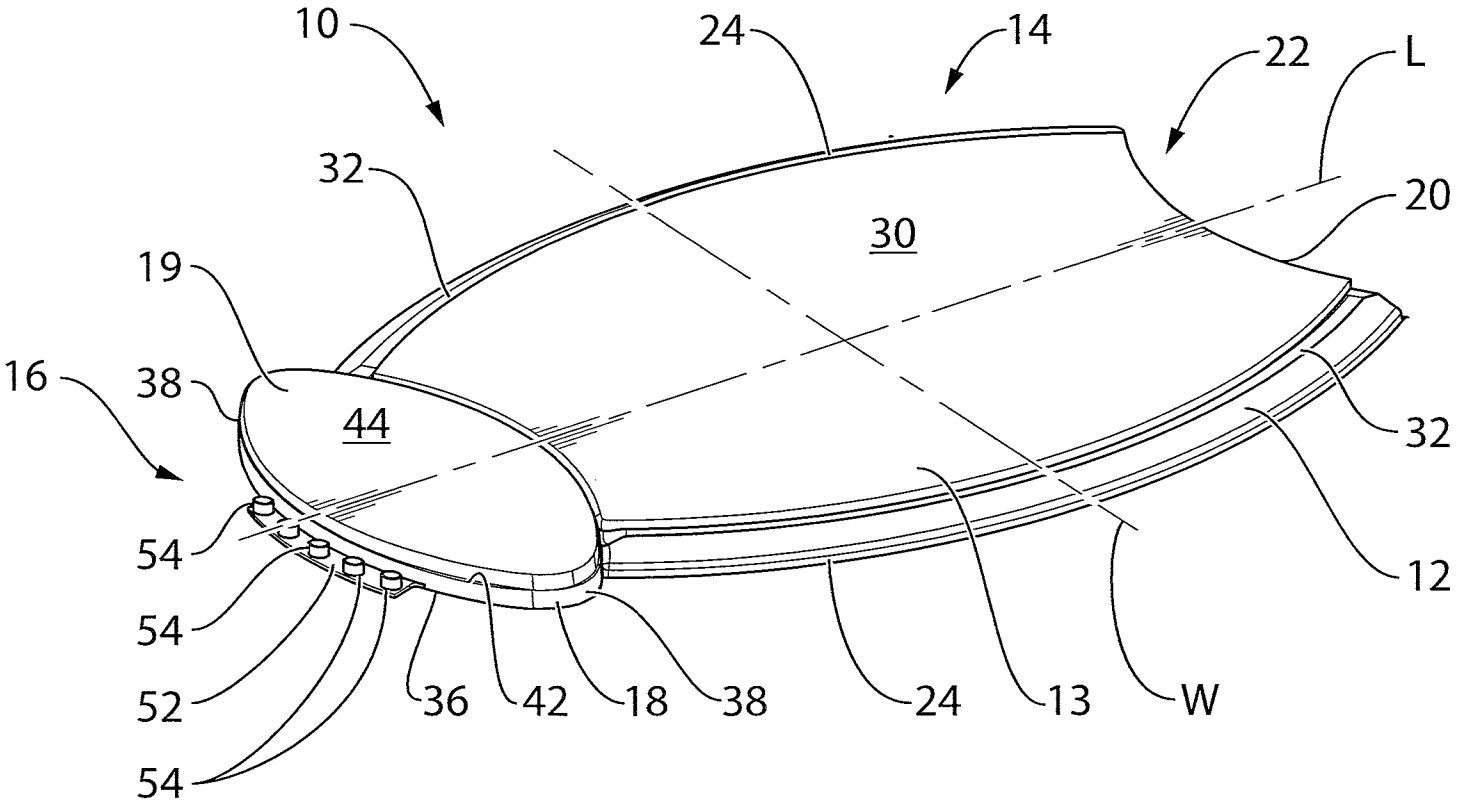
FIG. 1*b* is another perspective view of the golf practice mat assembly of FIG. 1*a;*
Figure 1C:
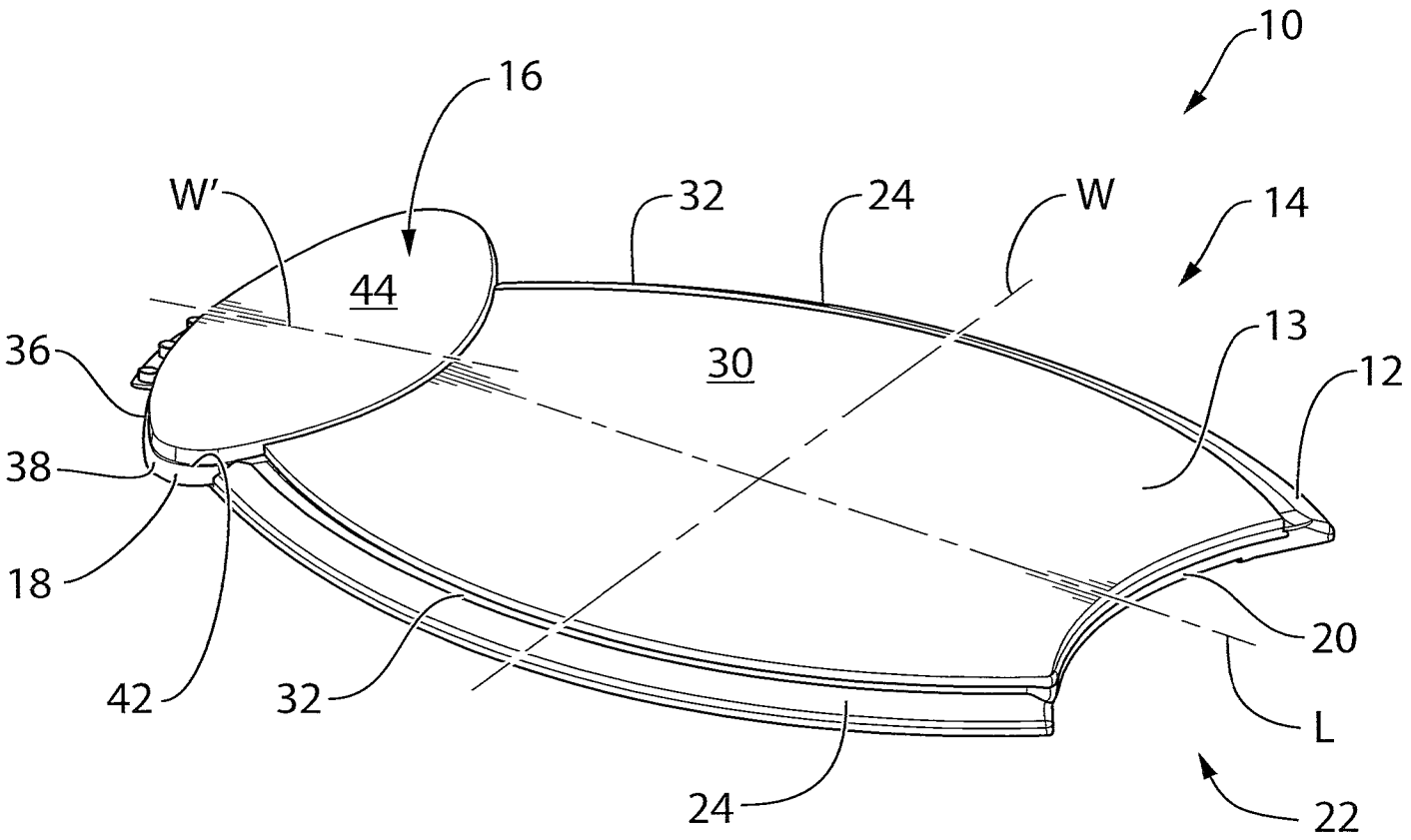
FIG. 1*c* is a plan view of the golf practice mat assembly with strike section reconnected to the stance section in an angular orientation where the mat has an overall curved configuration compared to the linear configuration of FIG. 1*a;*

Referring to FIGS. 1*a* and 1*b*, a golf practice mat assembly 10 comprises a stance section 14 and a strike section 16. There is a connection 17 between stance section 14 and strike section 16 that is releasable and selectively angularly configurable. This releasable connection, while maintaining the parts together during use, permits replacement of worn parts, such as strike sections, without requiring replacement of the whole mat assembly and permits customizable connection of the parts to form an overall assembly. The connection being selectively angularly configurable permits flexibility in the angle at which the stance section is connected to the strike section. The connection, being angularly selectable, permits connection of the two sections 14, 16 together at one of many possible angular orientations.

The stance section 14 has a stance base 12 and may optionally include a stance insert 13. The strike section 16 also has a strike base 18 and a simulated ground insert 19. The connection 17 is made between a first connector on an end of the stance section and a second connector on a side of the strike section. The end and the side are each shaped as a curve along their length, with the curve of the end of the stance section being substantially the reverse of the curve on the side of the strike section such that the end and the side can nest together with the end of the stance section 14 positioned closely against the side of the strike section 16. Details are set out herein below.

Base 12 of stance section 14 is formed of a layer of sheet material having an upper surface and a lower surface. In one embodiment, the stance section 14 has an overall oval (i.e. elliptical) shape having a cut out at one or both of ends 20, thereby forming a recess 22 along the length of end 20. Preferably, the recesses 22 are symmetrical about a long central axis L of the stance section 14 and are mirror images of one another with respect to a width-wise central axis W. Recesses 22 are curved from side 24 to side 24 preferably generally concave in shape with a radius of curvature.

The stance section 14 lengthwise sides 24 are shown convexly curved in the illustrated embodiment. However, the lengthwise sides 24 do not have to be curved; the sides 24 may be straight or be shaped otherwise.

In one embodiment, the upper surface of base 12 is configured to support and receive stance insert 13. For example, the upper surface of base 12 may include a recessed area, which is defined as the area between one or more ridges 32 projecting from the upper surface, for receiving insert 13. In the illustrated embodiment, each of the ridges 32 forms a continuous wall along one of the sides 24. In another embodiment, ridges 32 may comprise of two or more spaced-apart projections on the upper surface that, together, provide intermittent wall sections to define a recessed area. Ridges 32 do not necessarily have to be on or near sides 24. In the illustrated embodiment, the shape of the recessed area is substantially the same as and concentric with the shape of the base 12, but of course the recessed area may be of other shapes, including for example a circle, oval, polygon, etc., and does not have to take the same shape as or be concentric with the shape of the base 12. Ridges 32 may be thermally formed, as described in more detail below. Alternatively or additionally, ridges 32 may include one or more separate pieces of material that are attached to base 12.

The upper surface of base 12 may be textured. Base 12 may be a single piece of material or may be comprised of two or more pieces of material. In one embodiment, base 12 is the combination of two or more inter-connectable pieces of material.

Stance insert 13 is a piece of sheet material having a substantially planar upper surface 30. Stance insert 13 may be a substantially solid piece of material or at least a portion of insert 13 underneath upper surface 30 may be hollow. Stance insert 13 is sized to accommodate the golfer in a golf stance thereon, although the golfer may not be positioned on the insert 13 at all times when the mat assembly is in use. Some useful sizes may be those sized to accommodate a golfer in a golf stance such as a shape that is about 3 feet in width.

The stance insert 13 is also sized and shaped to fit over and cover a substantial portion of base 12. In one embodiment, stance insert 13 is shaped to be receivable in the recessed area, in between ridges 32. In a preferred embodiment, stance insert 13 is shaped and sized such that when it is installed on base 12, the lengthwise edges of insert 13 is substantially aligned with the lengthwise edges of the recessed area and are adjacent to the inner facing surfaces of ridges 32 (i.e. the surface facing the recessed area). Stance insert 13 has substantially the same length as base 12 or is shorter than base 12 such that insert 13, when installed on base 12, does not extend beyond the ends 20. Preferably, the ends of insert 13 are shaped to substantially match the curve of ends 20. More preferably, the ends of insert 13 are close to or substantially flush with ends 20 when insert 13 is installed in base 12. Optionally, the height of ridges 32 is approximately the same as the thickness of stance insert 13 such that when insert 13 is installed on base 12, upper surface 30 is substantially flush with the top edges of ridges 32.

Stance insert 13 is preferably removably installable on the upper surface of base 12. There are many ways that stance insert 13 and base 12 can be configured to allow insert 13 to be removably installable on base 12. For example, insert 13 may be installed between ridges 32 by interference fit. Alternatively or additionally, the height of ridges 23 is selected to keep insert 13 therebetween and to prevent excessive lateral movement of insert 13 on base 12 after installation. In one embodiment, ridges 32 are sufficient raised above the upper surface of base 12 such that insert 13 preferably can only be installed by vertical placement from above base 12, and only be removed from base 12 by lifting insert 13 upwards.

Figure 2A:
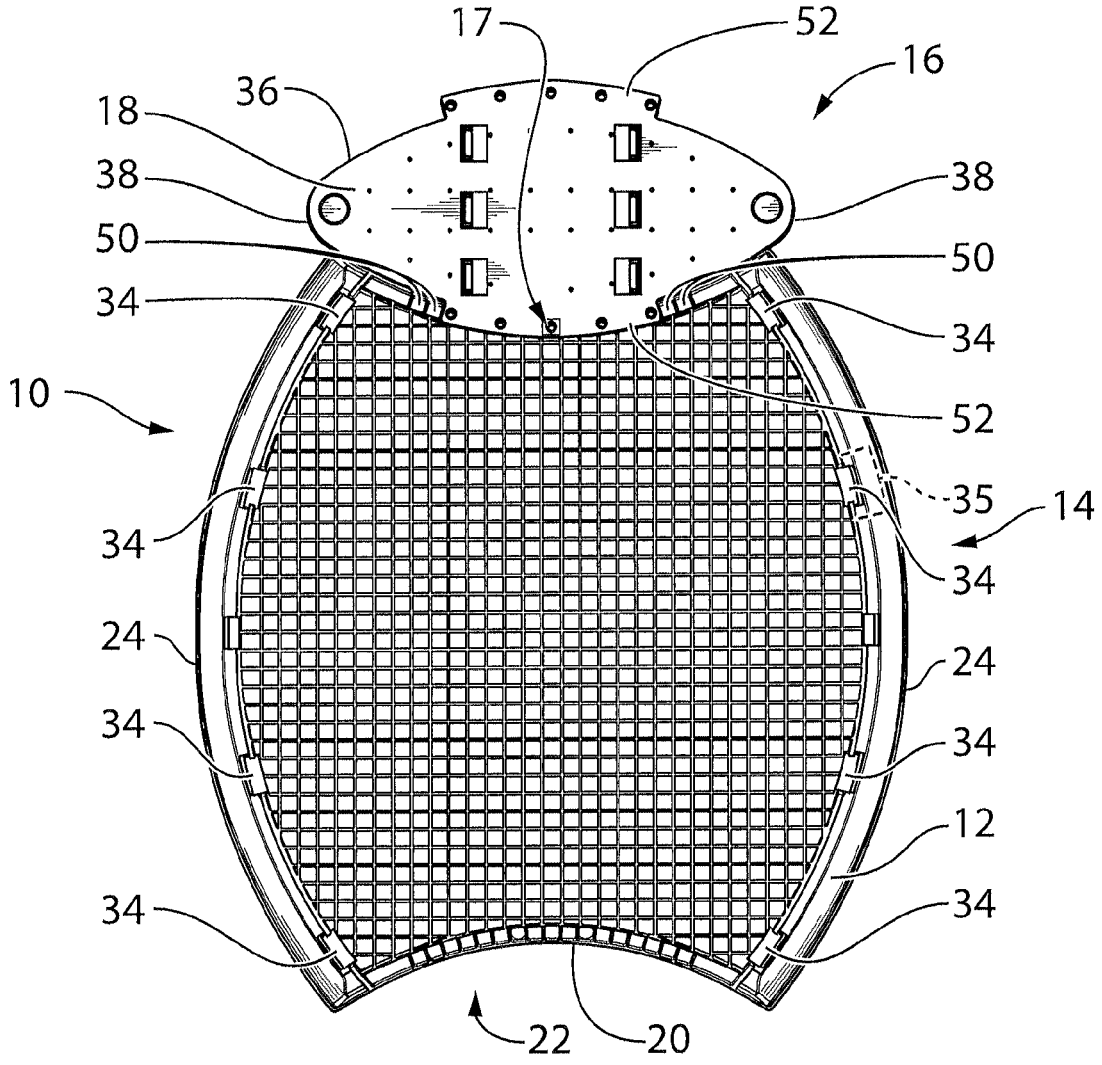
FIG. 2*a* is a bottom view of the golf practice mat assembly of FIG. 1*a;*
Figure 2B:
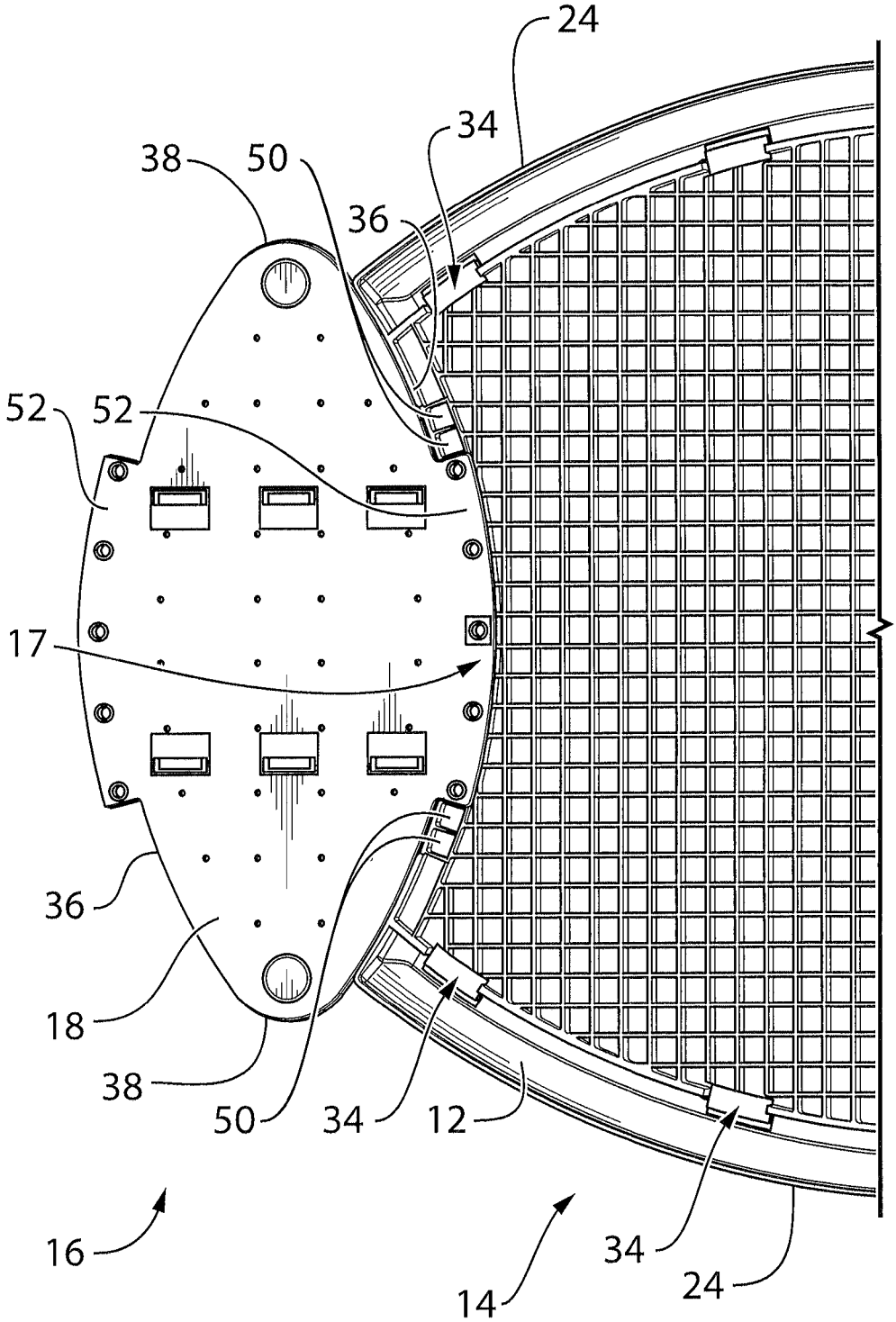
FIG. 2*b* is a detailed view of a portion of the golf practice mat assembly of FIG. 2*a;*
Figure 2C:
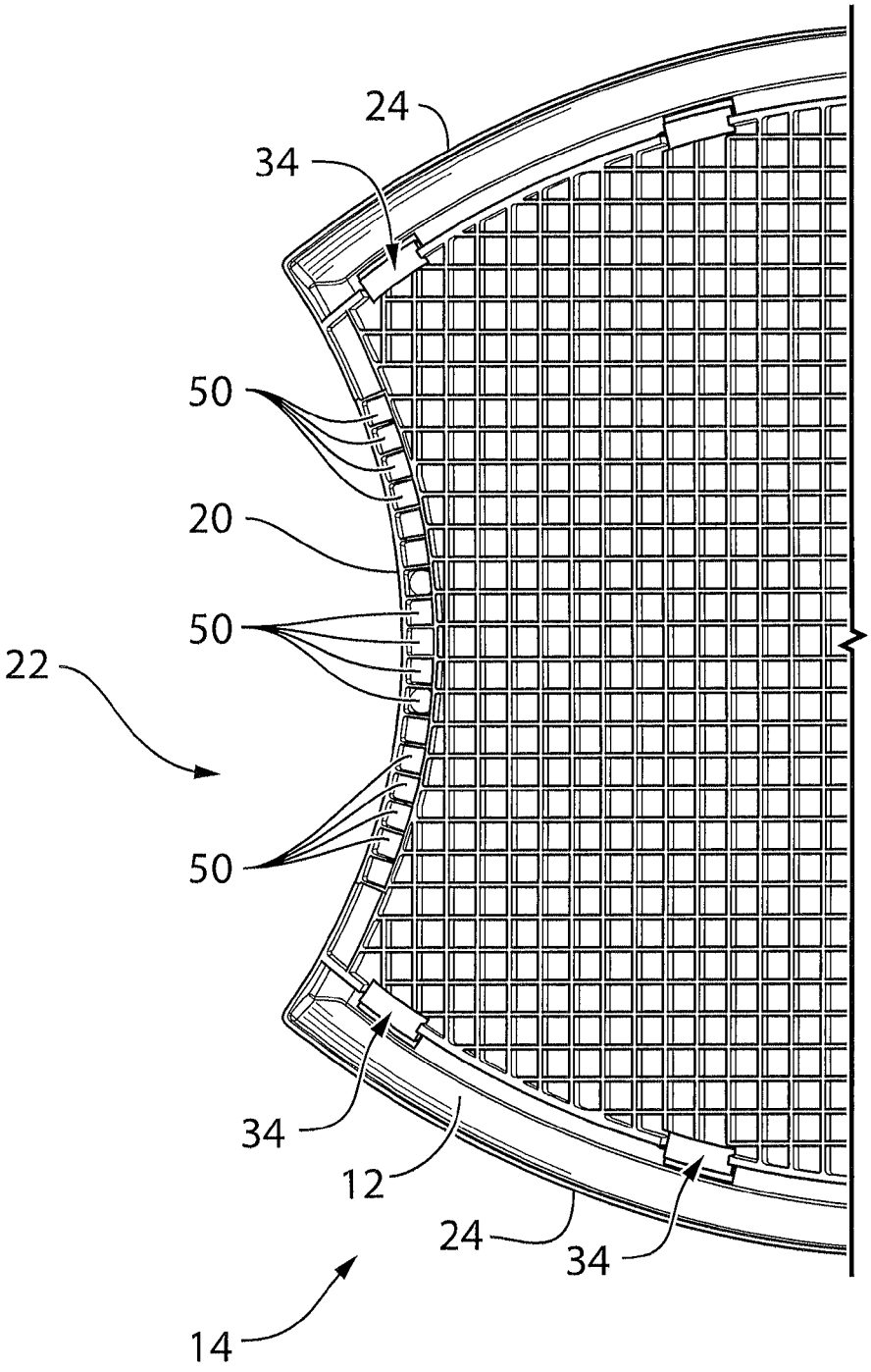
FIG. 2*c* is another detailed view of a portion of the golf practice mat assembly of FIG. 2*a*, but shown without one of the modules.

Alternatively or additionally, base 12 and insert 13 may include additional features for interconnection therebetween. For example, referring to FIG. 2*a*, base 12 includes a plurality of spaced-apart notches 34 near lengthwise sides 24. In one embodiment, the notches 34 extend from the inner facing surfaces of ridges 32 into ridges 32. If ridges 32 have a hollow underside, as shown in the illustrated embodiment, notches 34 may simply be spaced-apart openings and/or slits in the inner facing surfaces of ridges 32. Stance insert 13 may include a plurality of spaced-apart, laterally extending tabs 35 along its lengthwise edges for insertion into the notches 34. The spacing and number of tabs preferably correspond to the spacing and number of notches 34, such that one tab fits into each notch, thereby securing insert 13 in place on base 12. In a preferred embodiment, tabs 35 of insert 13 are somewhat flexible for facilitating the insertion of the tabs into the notches 34 during installation of insert 13. Tabs 35 may include a base through which they are joined to insert and laterally extending ears that can be pushed through a notch and will expand therein to resist a pull back of the tab from out of the notch.

In another embodiment, if each of ridges 32 is comprised of a plurality of spaced-apart ridges, stance insert 13 may include a plurality of laterally extending tabs that are receivable in the spaces between the plurality of ridges to engage ridges 32 in an interlocking manner. In another embodiment, insert 13 is configured to fit over and cover ridges 32 when installed so that ridges 32 are underneath the lengthwise sides of insert 13 to help support and secure the position of insert 13 on top of base 12. Stance insert 13 may also be removably secured to base 12 by clips, clamps, fasteners, etc. whether or not base 12 is provided with ridges 32.

Alternatively, stance insert 13 may be permanently fixed to base 12 or may be formed together with base 12 from a single piece of material.

Whatever material base 12 and stance insert 13 are made of and however base 12 and stance insert 13 are constructed, base 12 and stance insert 13 are configured to support the weight of a golfer and to provide a firm surface on which the golfer positions himself while hitting golf balls. Upper surface 30 may be textured to enhance frictional engagement with the soles of the golfer's shoes.

In another embodiment, ridges 32 and stance insert 13 are optional. Base 12 alone is capable of supporting the golfer such that it may not be necessary to add an insert thereon. In a further embodiment, base 12 may be formed to provide a raised platform (instead of the recessed area) that is configured to accommodate and support the golfer in a golf stance thereon.

Figure 3:
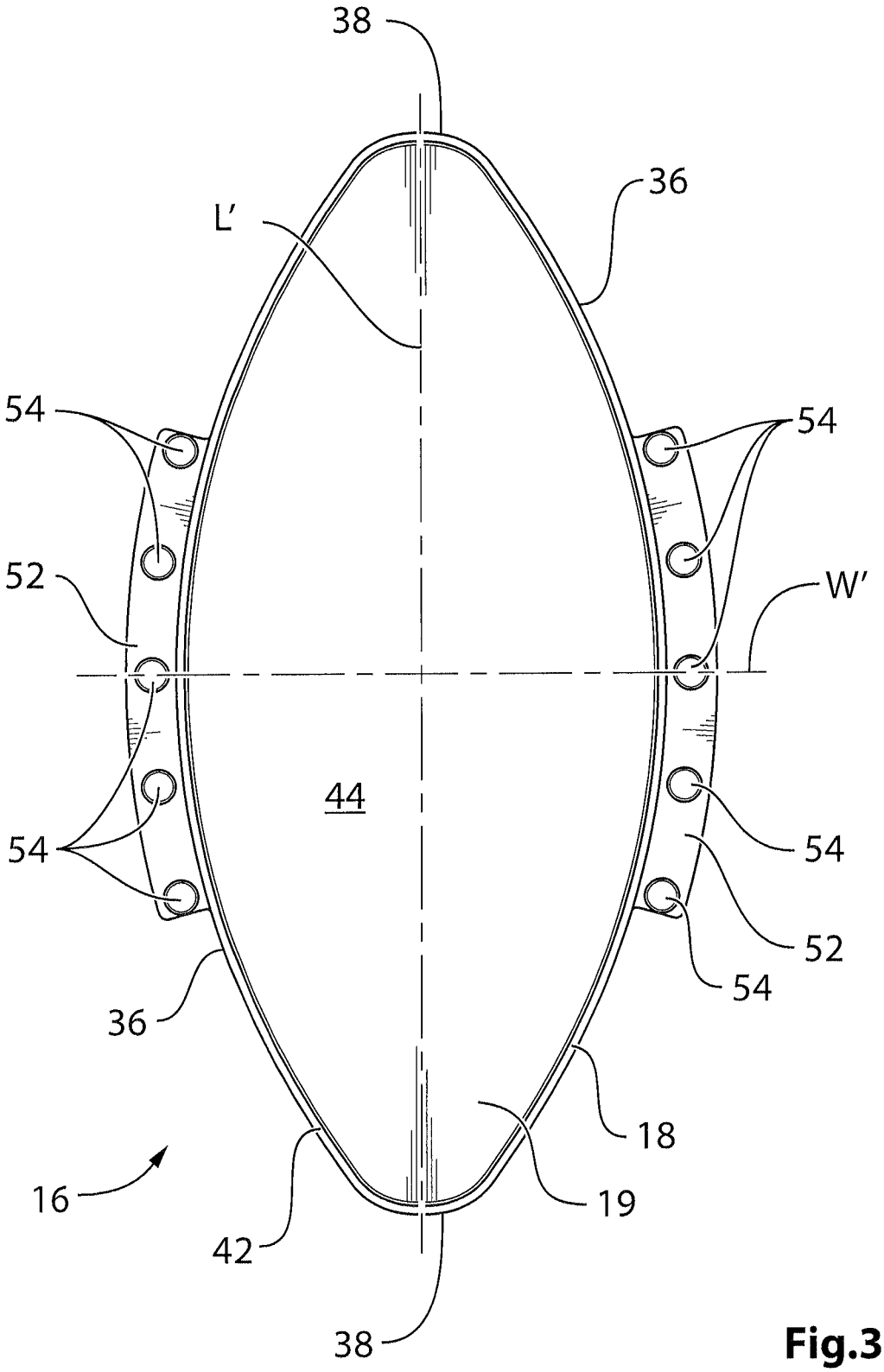
FIG. 3 is a top view of a module for a strike section of the golf practice mat assembly.

Referring to FIGS. 1*a*, 1*b* and 3, strike section 16 has a generally oval shape with sides 36 and ends 38. Preferably, sides 36 are symmetrical about a width-wise central axis W' of the strike section 16 and are mirror images of one another with respect to a long central axis L'. One or both sides 36 are preferably generally convex in shape and have substantially the same curvature as that of ends 20 of base 12, for example with substantially the same radius of curvature, such that at least a portion of side 36 is receivable in recess 22 and mate-able with end 20 through a range of rotational orientations between side 36 of strike section and recess 22. Base 18 of strike section 16 is formed of a layer of sheet material having an upper surface and a lower surface. In the illustrated embodiment, base 18 has an overall oval shape. Of course, the strike area 16 and/or base 18 may be of other shapes, including for example a circle, crescent, polygon, etc.

The upper surface of base 18 is configured to support and receive simulated ground insert 19. For example, the upper surface of base 18 may include a recessed area, which is defined by one or more ridges 42 projecting from the upper surface, for receiving insert 19. In the illustrated embodiment, ridge 42 forms a continuous wall substantially along the edge of the upper surface. In another embodiment, ridge 42 may comprise of two or more spaced-apart projections on the upper surface that, together, provide intermittent wall sections to define a recessed area. Ridge 42 does not necessarily have to be on or near the edge of the upper surface. In the illustrated embodiment, the shape of the recessed area is substantially the same as and concentric with the shape of the base 18, but of course the recessed area may be of other shapes, including for example a circle, oval, polygon, etc., and does not have to take the same shape as or be concentric with the shape of the base 18. Ridge 42 may be thermally formed, as described in more detail below. Alternatively or additionally, ridge 42 may include one or more separate pieces of material that are attached to base 18.

The upper surface of base 18 may be textured. Base 18 may be a single piece of material or may be comprised of two or more pieces of material. In one embodiment, base 18 is the combination of two or more inter-connectable pieces of material.

Simulated ground insert 19 is a piece of sheet material that is installable on base 18. In a preferred embodiment, insert 50 is removably receivable in strike section 16. Simulated ground insert 19 may be textured and may include foam construction or fibers. While other constructions may be used, insert 19, in one embodiment, includes an upper surface 44 formed of an artificial turf material including fibers in cut strands and/or loops extending from a backing material that acts as a more structurally secure portion to retain the fibers. Fiber lengths may vary from insert to insert or within an insert, as desired. The fibers of insert 19 may be formed of various materials including example, plastics and polymers. Simulated ground insert 19 is constructed to support a golf ball and to withstand repeated club strikes.

Optionally, insert 19 maybe framed by a rim to facilitate handling (e.g. installation and removal) thereof. The rim may be made of various materials, including plastic and rubber, and may be an extension of the backing material.

Insert 19 is sized to fit over and cover a substantial portion of the upper surface of base 18, and fit within ridge 42 if ridge 42 is provided. Simulated ground insert 19 is also sized to accommodate a golf ball thereon and optionally a portion of the golfer's golf swing that may come into contact with the mat, whether or not the golfer hits the ball (e.g. missed shots or practice swings). It can be appreciated that a ball may not be positioned in the strike area at all times when the mat is in use. Some useful sizes may be those sized to accommodate a ball and a portion of a golf swing such as an approximately one to four foot length (or diameter) circle or oval. Of course, insert 19 may be shaped other than in the form of a circle or oval.

In one embodiment, simulated ground insert 19 is shaped to be receivable in the recessed area of base 18, within ridge 42. In a further embodiment, simulated ground insert 19 is shaped and sized such that when it is received in the recessed area of base 18, the edges of insert 19 are adjacent to the inner facing surface of ridge 42 (i.e. the surface facing the recessed area). In a further embodiment, ridge 42 substantially frames insert 19. In a still further embodiment, the height of ridge 42 is less than the thickness of insert 19 such that when insert 19 is received in the recessed area of base 18, upper surface 44 is above the top edge of ridge 42, as shown for example in FIGS. 1*a* and 1*b*.

Simulated ground insert 19 is preferably removably installable on the upper surface of base 18. There are many ways that insert 19 and base 18 can be configured to allow insert 19 to be removably installable on base 18. In one embodiment, insert 19 is installed in on base 18 by placing insert 19 on the recessed area defined by ridge 42, with upper surface 44 facing upwards away from the upper surface of base 18. Insert 19 may be secured on the recessed area within ridge 42 by an interference fit. Alternatively or additionally, the height of ridges 42 is selected to keep insert 19 within the recessed area and to prevent excessive lateral movement of insert 19 on base 18 after installation. In one embodiment, ridges 42 are sufficient raised above the upper surface of base 18 such that insert 19 preferably can only be installed by vertical placement from above base 18, and only be removed from base 18 by lifting insert 19 upwards.

Alternatively or additionally, base 18 and insert 19 may include additional features for interconnection therebetween. For example, if ridge 42 is comprised of a plurality of spaced-apart ridges, the edges of simulated ground insert 19 may include a plurality of laterally extending tabs, such as described above in respect of tabs 35, which are receivable in the spaces between the plurality of ridges to engage ridge 42 in an interlocking manner. In another embodiment, insert 19 is configured to fit over and cover ridge 42 when installed so that ridge 42 is underneath the edges of insert 19 to help support and secure the position of insert 19 on top of base 18. Simulated ground insert 19 may also be removably secured to base 18 by clips, clamps, fasteners, etc. whether or not base 18 is provided with ridge 42.

Alternatively, simulated ground insert 19 may be permanently fixed to base 18 or may be formed together with base 18 from a single piece of material.

Because of the forces generated in the golf swing and transferred into the mat both through the golfer and the club, it is useful to have a connection between the stance section and the strike section. However, to permit replacement of worn parts, such as strike sections, without requiring replacement of the whole mat assembly, the connection may be non-permanent. To permit flexibility in the angle at which the stance section is connected to the strike section, the connection can be angularly selectable to permit the sections to be connected at one of a plurality of possible angular orientations. The connection 17 may permit the strike and stance sections to be releasably secured together with the strike section secured at an edge of the stance section in one of a plurality of possible rotational orientations relative to the stance section. In other words sections 14, 16 may be connected with the axis L of the stance section and the axis W' of the strike section in alignment or out of alignment.

Referring to FIGS. 1*b*, 2*a*, 2*b*, 2*c* and 3, there are many ways to connect the strike section 16 to the stance section 14, while providing for this selection of the angle of one relative to the other. There is a connector on the stance section and a connector on the strike section. For example, in the illustrated embodiment, the lower surface of base 12 includes a series of indentations 50 near end 20 between sides 24. The series of indentations 50 are positioned along end 20, each indentation being substantially the same distance from end and the series of indentations are aligned along, and follow the curvature of, end 20. Further, one or both sides 36 of base 18 include a lateral extension 52 having an upper surface and a plurality of pegs 54 (sometimes also referred to as knobs) projecting substantially perpendicularly therefrom. The plurality of pegs 54 are each sized to be receivable in an indentation 50 when one of ends 20 of base 12 is placed on top of one of the lateral extensions 52, with a portion of the corresponding side 36 in recess 22 and adjacent to end 20. Optionally, the pegs and indentations are sized to provide an interference fit therebetween such as by a close fit, a snap fit or by use of an integral or additional fastener. If strike section 16 is circular in shape, it may have a substantially continuous lateral extension with pegs thereon around the entire circumference.

Preferably, the spacing of each of pegs 54 and indentations 50 is such that when one peg 54 is received in one indentation, at least one other peg may be received in another indentation. In other words, the distance from the center point of one peg 54 to the center point of a next peg 54 is the same as, or a multiple of, the distance from the center point of one indentation 50 to the center point of a next indentation For example, adjacent knobs 54 may be spaced apart by the width of one indentation 50 such that when each knob is received in an indentation (when end 20 is placed on top of lateral extension 52), the adjacent knobs are separated by an empty indentation.

In this manner, the strike section and stance section can be connected to one another by inserting at least one peg 54 into any of the indentations, with the corresponding side 36 adjacent to end 20. When end 20 is placed on top of lateral extension 52, with at least one peg received in an indentation, end 20 and side 36 are closely positioned and, for example, mate and an interlocking interface is formed between lateral extension 52 and end 20, such that relative rotational and lateral movement between strike section 16 and stance section 14 is restricted. Further, the angle of axis W' of strike section 16 relative to axis L of stance section 14 can be selectively varied by pulling the sections apart and inserting the at least one peg into a different indentation. The angle between axis W' and axis L can increase and decrease in the directions indicated by arrows C in FIG. 1*a*. In a preferred embodiment, the curvatures of side 36 and recess 20 are selected such that they complement each other (i.e. at least a portion of side 36 abuts and/or is adjacent to at least a portion of end 20) when at least one peg is inserted into an indentation, regardless of the angle of axis W' relative to axis L. For example, the curvature along the length of the curved portion of side 36 is substantially the same but the reverse of the curvature along the length of end 20 and the connectors on stance section 14 fit with the connectors on strike section 16.

Preferably, when at least one peg 54 is received in an indentation 50, upper surfaces 30 and 44 are substantially parallel with one another. Even more preferably, when at least one peg 54 is received in an indentation 50, upper surfaces 30 and 44 are substantially flush with one another.

Alternatively, the configuration of bases 12 and 18 may be reversed. For example, lateral extensions with pegs thereon may be provided on one or both of ends 20, instead of sides 36, and corresponding indentations are provided near one or both sides 36, instead of ends 20. Further, the pegs may extend from a lower surface of the lateral extension and the indentations may be provided on the upper surface of the base. Other variations are possible.

The connectors can take other forms. For example, while pegs/indentations are shown as square or cylindrical, they may be more elongated, for example, formed as tongues and grooves. In another sample embodiment, base 18 has a plurality of laterally extending tongues along one or both sides 36 thereof and base 12 has a plurality of grooves along one or both ends 20 thereof, each groove for receiving a tongue to form an interlocking interface therebetween. Optionally, the tongues and grooves are sized to provide an interference fit therebetween. The spacing of the tongues and grooves is selected such that when one tongue is received in one groove, at least another tongue can be received in another groove. For example, adjacent tongues may be spaced apart by the width of one groove such that when each tongue is received in a groove, the adjacent tongues are separated by an empty groove.

The strike section 16 and stance section 14 are connected at side 36 and end 20 when at least one tongue on side 36 is received in a groove of end 20. The connection between the strike and stance section, formed by interlocking at least one tongue with at least one groove, helps restrict relative rotational and lateral movement between the sections. Further, the angle of axis W' of strike section 16 relative to axis L of stance section 14 can be selectively varied by inserting the at least one tongue into a different groove. In a preferred embodiment, the curvatures of side 36 and recess 20 are selected such that they complement each other (i.e. at least a portion of side 36 abuts and/or is adjacent to at least a portion of end 20) when at least one tongue is received in a groove, regardless of the angle of axis W' relative to axis L.

Preferably, when at least one tongue is received in one of the grooves, upper surfaces 30 and 44 are substantially parallel with one another. Even more preferably, when at least one tongue is received in a groove, upper surfaces 30 and 44 are substantially flush with one another.

Alternatively, the configuration of bases 12 and 18 may be reversed. For example, tongues may be provided on one or both of ends 20, instead of sides 36, and corresponding grooves are provided on one or both sides 36, instead of ends 20.

Other embodiments for connecting strike section and stance section are possible. For example, one or both sides 36 and one or both ends 20 may include a series of holes thereon, and the spacing of the holes is preferably substantially the same for both side 36 and end 20. Strike section and stance section may be connected to each other by aligning one or more of the holes on side 36 with one or more of the holes on end 20 and inserting a removable pin, fastener, or the like through the aligned holes to releasably secure the strike and stance sections to each other. Similarly, the angle of axis W' relative to axis L is adjustable depending on which holes are aligned and fastened together. Once the fasteners are in place, relative lateral and rotational movement between the strike and stance sections is restricted. In a further embodiment, strike section and stance section may be releasably interconnected by clips, clamps, fasteners, etc. In a still further embodiment, strike section may be connected to stance section using a combination of any two or more of the above described methods.

In a further alternative embodiment, one or both ends 20 may be convex rather than concave and one or both sides 36 may be concave rather than convex for mating and connecting with a convex end 20, via one or more of the above-mentioned ways of connection.

In a preferred embodiment, sides 36 are mirror images of each other about lengthwise axis L', and ends 20 are mirror images of each other about width-wise axis W. Since strike section 16 and stance 14 may be of shapes other than an oval, "lengthwise axis" herein refers to an axis passing through the midpoints of both ends and "width-wise axis" herein refers to an axis passing through the midpoints of both sides. In this embodiment, each side 36 is connectable to either end 20, and vice versa. This provides flexibility in configuring a modular golf mat assembly, as described in further detail hereinbelow.

A golf mat assembly of the present invention includes at least one module, i.e. a stance section or a strike section. The golf mat assembly may further comprise one or more additional modules, which include: (i) a strike section(s); (ii) a stance section(s); and (iii) a tray(s) for golf accessories.

Figure 4:
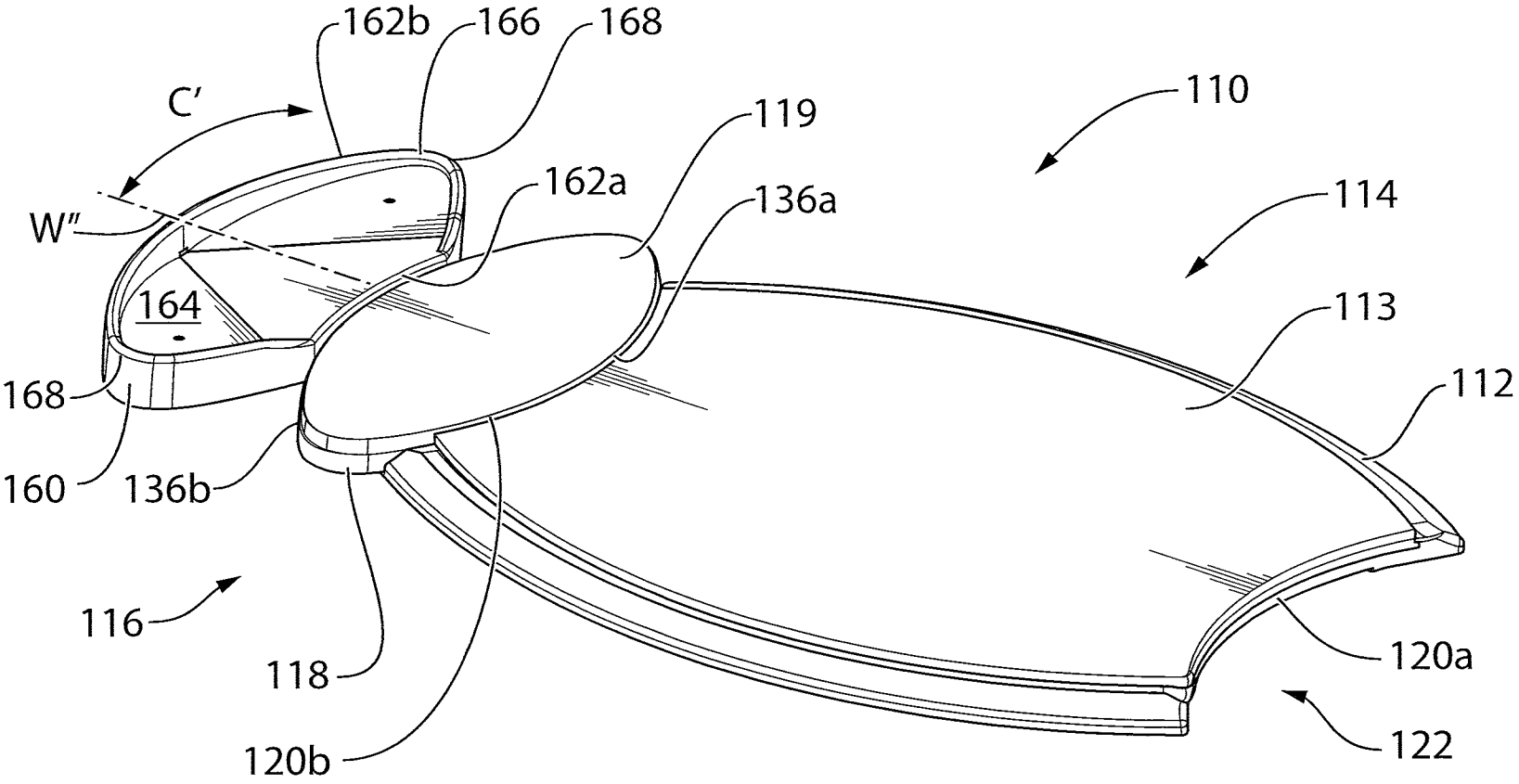
FIG. 4 is a perspective view of another embodiment of the golf practice mat assembly.
Figure 5A:
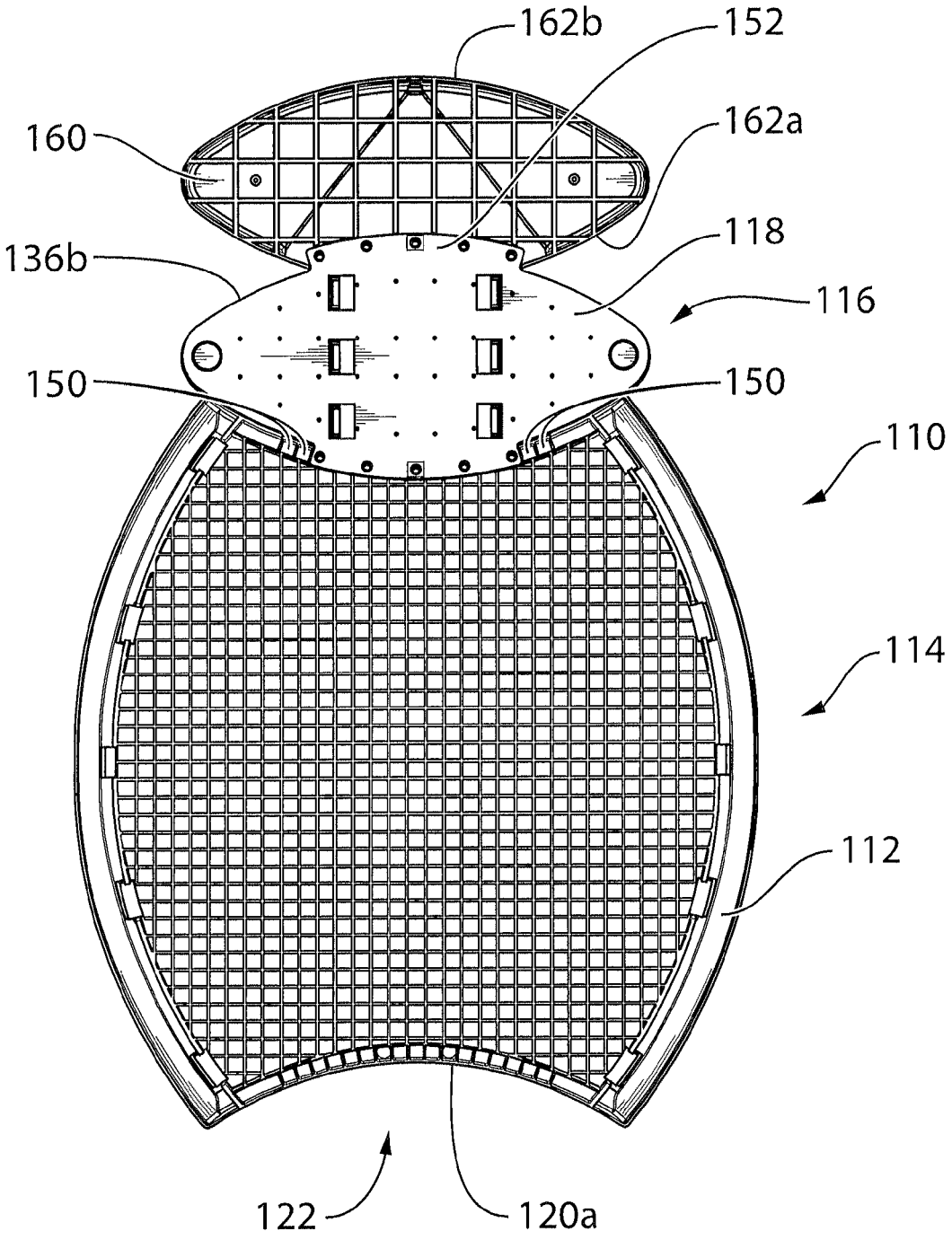
FIG. 5*a* is a bottom view of the golf practice mat assembly of FIG. 4.
Figure 5B:
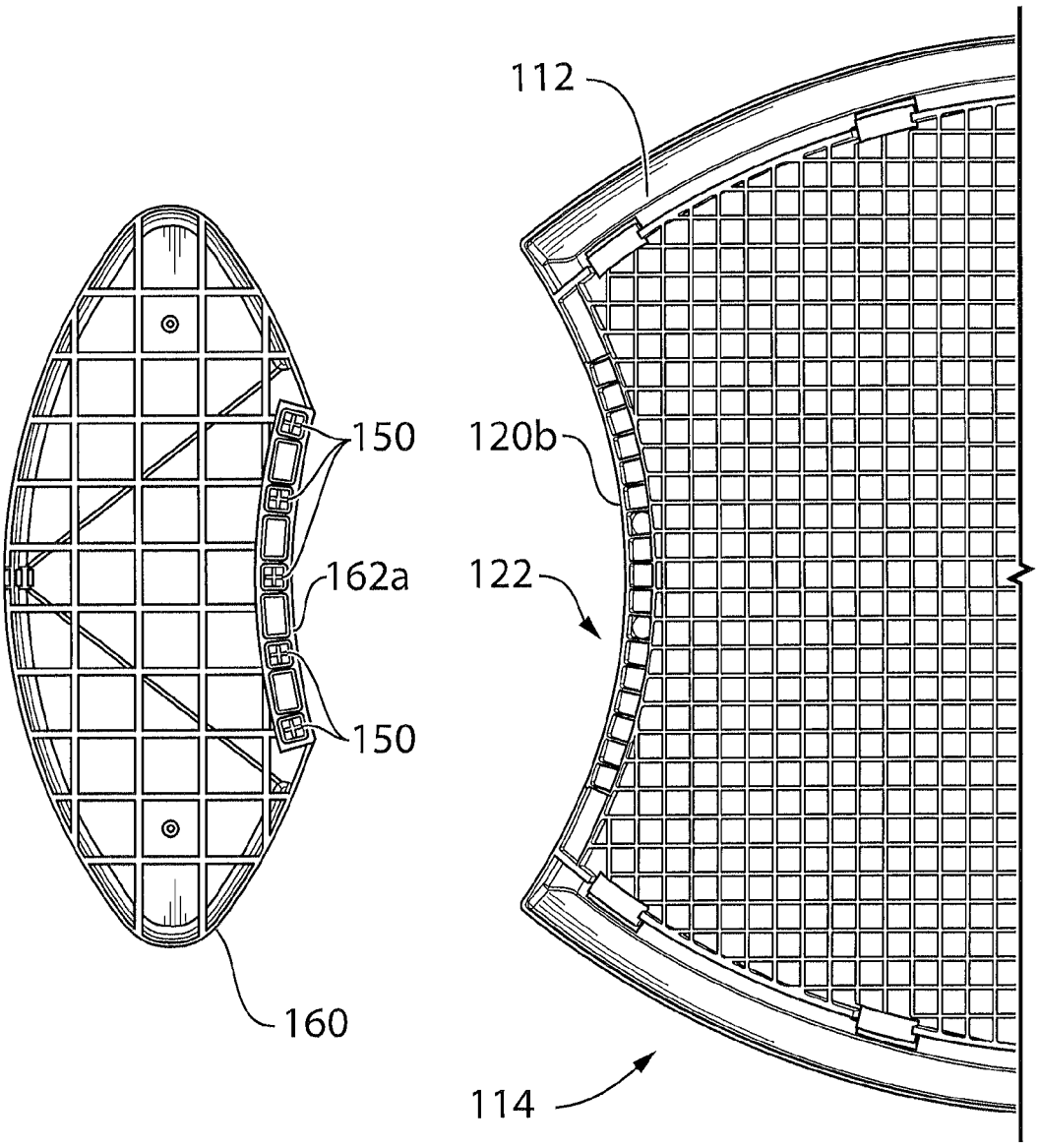
FIG. 5*b* is a detailed view of a portion of the golf practice mat assembly of FIG. 4, but shown without one of the modules.

For example, referring to FIGS. 4, 5*a* and 5*b*, a golf mat assembly 110 comprises a first strike section 116 and a first stance section 114. In one embodiment, strike section 116 and stance section 114 include the same features as those above described with reference to strike section 16 and stance section 14, respectively. Preferably, strike section 116 includes a base 118 that is configured to receive and support a simulated ground insert 119 and stance section 114 includes a base 112 that is configured to receive and support a stance insert 113. In the illustrated embodiment, strike section 116 has convex sides 136*a*, 136*b*. Stance section 114 has ends 120*a*, 120*b*, providing concave recesses 122 for receiving a portion of one side 136*a* or 136*b*. The strike section and stance section are interconnected at a first side 136*a* and a first end 120*b*, respectively, in accordance with the various methods described above.

Golf mat assembly 110 may further include a third module in addition to strike section 116 and stance section 114. In the illustrated embodiment, the mat assembly 110 further comprises a third module, which is a tray 160 for holding golf accessories, such as for example golf balls, tees, etc.

For the sake of clarity, the third module of the golf mat assembly does not have to be a tray; the third module may be an additional strike section, an additional stance section, a tray, etc.

Tray 160 has a generally oval shape in plan view with sides 162*a*, 162*b*. Tray 160 is intended to be attached at one or both of its sides adjacent a stance section 14, strike section 16 or another tray. One or both sides 162*a*, 162*b* are, therefore, shaped as required to mate with the edge against which it is to be connected and one or both sides 162*a*, 162*b* include connectors that releasably connect to the connectors on the adjacent stance section 14, 114, strike section 16, 116 or another tray. The connectors to releasably secure the tray to the other component are configured to permit the tray to be secured at one of a plurality of rotational orientations.

In the illustrated embodiment, tray 160 is intended to be secured against strike section 116 on the opposite side of the strike sections connection to stance section 114. As such, the at least one side 162*a* is generally concave in shape to provide a recess and has substantially the same curvature as that of one of sides 136*a*, 136*b* of strike section 116, such that at least a portion of side 136*a* or 136*b* is receivable in the recess and is mate-able with concave side 162*a*. Tray 160 has an upper surface, a lower surface, and a width-wise axis W" extending between sides 162*a* and 162*b*. The upper surface of tray 160 is configured to hold golf balls, tees, and/or other golf accessories. For example, the upper surface of tray 160 may include a recessed area 164. Although tray 160 is shown to have a generally oval shape, tray 160 may be of other shapes, including for example a circle, crescent, polygon, hourglass, etc.

In one embodiment, the recessed area 164 is defined by a ridge 166 projecting from the upper surface of tray 160. In the illustrated embodiment, ridge 166 forms a substantially continuous wall along a portion of the edge of the upper surface. Preferably, ridge 166 has a gap at a concave side 162*a*. Ridge 166 does not necessarily have to be on or near the edge of the upper surface. Ridge 166 may be thermally formed, as described in more detail below. The upper surface of tray 160 may be textured. Recessed area 164 may have an upper surface that is sloped to allow any golf accessories therein to concentrate in a certain area by the force of gravity. Tray 160 may be a single piece of material or may be comprised of two or more pieces of material.

It can be appreciated that golf accessories may not be positioned in tray 160 at all times when the mat assembly is in use. Some useful sizes may be those sized to accommodate golf accessories, for example, trays of various sizes that hold a pyramid shape of golf balls, a bag of golf balls, teaching accessories, logos and advertising, etc.

In one embodiment, tray 160 is connectable to a second side 136*b* of strike section 116. There are many ways to connect tray 160 to strike section 116. For example, similar to the lower surface of base 12, described above, the lower surface of tray 160 may include a series of indentations 150 near side 162*a* (see FIG. 5*b*). The series of indentations 150 are positioned along side 162*a* such that the indentations follow the curvature of side 162*a*. Further, side 136*b* of base 118 include a lateral extension 152 having an upper surface and a plurality of pegs projecting substantially perpendicularly therefrom. The plurality of pegs are each sized to be receivable in an indentation 150 when side 136*b* of tray 160 is placed on the upper surface of lateral extension 152, with a portion of side 136*b* adjacent to side 162*a*, in the recess defined by side 162*a*. Optionally, the pegs and indentations are sized to provide an interference fit therebetween. If strike section 116 is circular in shape, it may have a substantially continuous lateral extension with pegs thereon around the entire circumference.

Preferably, the spacing of the pegs on extension 152 and indentations 150 is such that when one peg is received in one indentation, at least one other peg may be received in another indentation. For example, in the illustrated embodiment, the spacing between adjacent knobs is substantially the same as that between adjacent indentations 150.

In this manner, tray 160 and strike section 116 can be connected to one another by inserting at least one peg into any of the indentations 150, with the corresponding side 136*b* adjacent to side 162*a*. When side 162*a* is placed on top of lateral extension 152, with at least one peg received in an indentation, an interlocking interface is formed between lateral extension 152 and side 162*a*, such that relative rotational and lateral movement between strike section 116 and tray 160 is restricted. Further, the angle of axis W" of tray 160 relative to the width-wise axis of strike section 116 can be selectively varied by inserting the at least one peg on side 136*b* into a different indentation 150. The angle between axis W" and the width-wise axis of strike section 116 can increase and decrease in the directions indicated by arrows C' in FIG. 4. In a preferred embodiment, the curvatures of sides 136*b* and 162*a* are selected such that they complement each other (i.e. at least a portion of side 136*b* abuts and/or is adjacent to at least a portion of side 162*a*) when at least one peg is inserted into an indentation 150, regardless of the angle of axis W" relative to the width-wise axis of strike section 116.

Alternatively, the configuration of strike section 116 and tray 160 may be reversed. For example, laterally extensions with pegs thereon may be provided on one or both of sides 162*a*, 162*b*, instead of sides 136*b*, and corresponding indentations are provided near side 136*b*, instead of side 162*a*. Further, the pegs may extend from a lower surface of the lateral extension and the indentations may be provided on the upper surface. Other variations are possible.

Other ways to connect tray 160 to strike section 116 are possible, such as those described above in relation to connecting strike section 16 to stance section 14. Further, tray 160 and/or a second side 120*a* of stance section 114 may be configured such that tray 160 is connectable to the second end 120*a* of stance section 114. For example, one of the sides 162*a*, 162*b* has a convex curvature and includes a lateral extension with pegs thereon, similar to lateral extension 152 of strike section 116. Side 120*a* of stance section 114 has indentations on its lower surface for receiving the pegs of tray 160, in a manner as described above. In an alternative sample embodiment, side 120*a* is convex and side 162*a* or 162*b* is concave for receiving a portion of side 120*a*. Other variations and other ways for connecting tray 160 to stance section 114 are possible.

When tray 160 is connected to strike section 116 or stance section 114, the gap in ridge 166 at side 162*a* preferably provides a passage between the recessed area on tray 160 and the upper surface of strike section 116 or stance section 114, respectively, to facilitate the transferring of golf accessories (e.g. golf balls) therebetween. Preferably, when tray is connected to strike section 116 or stance section 114, the upper surface of tray 160 at the gap and the upper surface of strike section 116 or stance section 114, respectively, are substantially parallel with one another. Even more preferably, when tray is connected to strike section 116 or stance section 114, the upper surface of tray 160 at the gap and the upper surface of strike section 116 or stance section 114, respectively, are substantially flush with one another.

In one embodiment, side 162*a* of ball tray 160 is configured to be connectable with either side 136*a*, 136*b* of strike section 116. In another embodiment, side 162*a* is configured to be connectable with either side 120*a*, 120*b* of stance section 114. In a further embodiment, sides 162*a* and 162*b* are mirror images of one another about the lengthwise axis of tray 160, such that either side 162*a*, 162*b* is connectable to strike section 116 or stance section 114. In an alternate embodiment, one side 162*a* is configured to connect with strike section 116 while the other side 162*b* is configured to connect with stance section 114. Thus, tray 160 can be configured to allow for flexibility in configuring the golf mat assembly, as described in more detail below.

Figure 6:
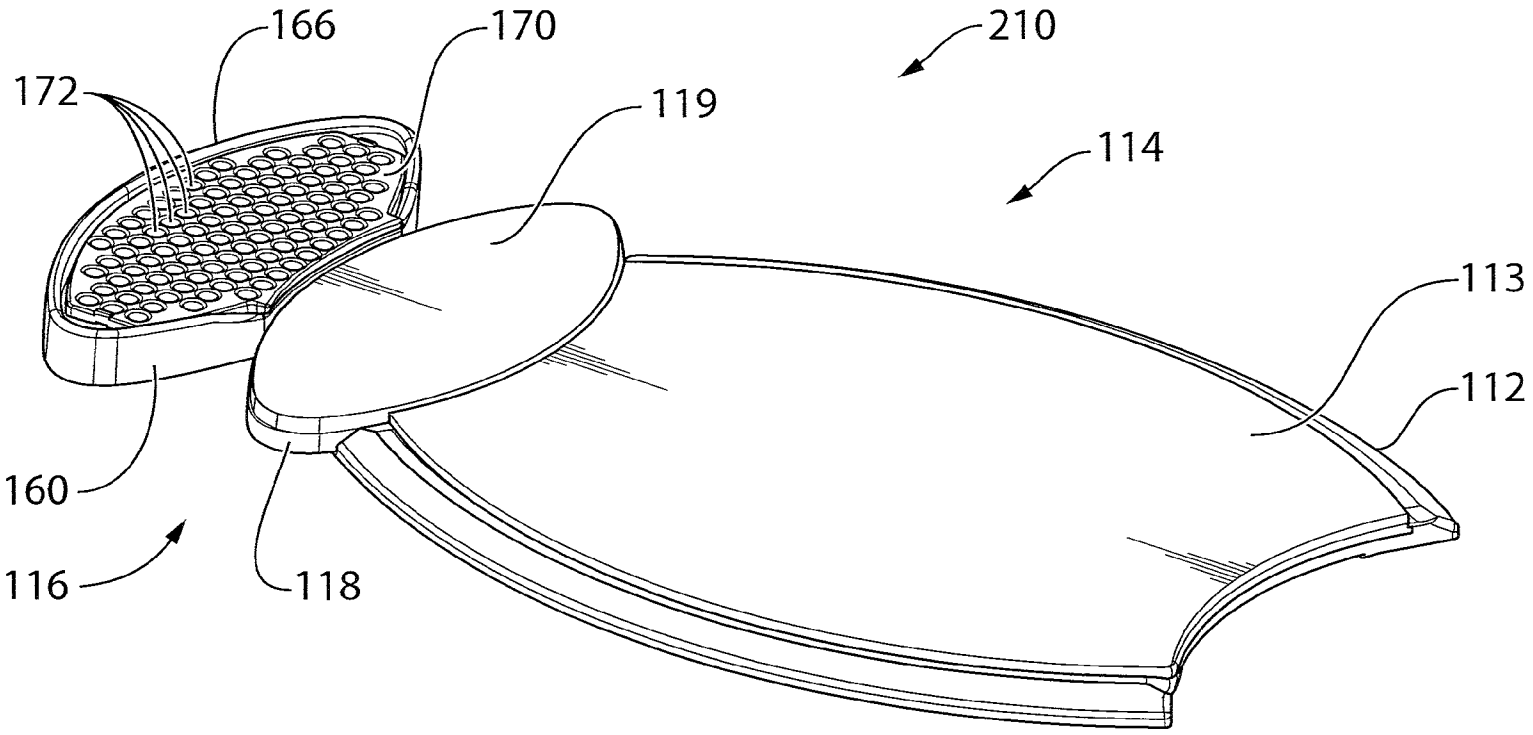
FIG. 6 is a perspective view of yet another embodiment of the golf practice mat assembly.

There are other types of ball trays. Referring to FIG. 6, a practice golf mat assembly 210 comprises first strike section 116, first stance section 114, and tray 160, all as described above with respect to assembly 110. Assembly 210 further comprises a ball tray 170. Ball tray 170 has an upper surface having a plurality of indentations 172, each sized to receive a portion of a golf ball. Ball tray 170 allows a plurality of golf balls to be placed thereon in an organized manner.

In one embodiment, ball tray 170 is sized and shaped to be receivable in the recessed area of tray 160, within ridge 166. In a further embodiment, ball tray 170 is shaped and sized such that when it is received in the recessed area of tray 160, the edges of ball tray 170 are adjacent to the inner facing surface of ridge 166 (i.e. the surface facing the recessed area). In a still further embodiment, ridge 166 substantially frames ball tray 170. Optionally, the height of ridge 166 may be substantially the same as the thickness of ball tray 170 such that when ball tray 170 is received in the recessed area of tray 160, the upper surface of ball tray 170 is substantially flush with the top edge of ridge 166.

In one embodiment, ball tray 170 is removably installable in the recessed area of tray 160. There are many ways that ball tray 170 and tray 160 can be configured to allow ball tray 170 to be removably installable on tray 160. Ball tray 170 is installed in on tray 160 by placing insert 19 on the recessed area defined by ridge 166, with its upper surface facing upwards away from the upper surface of tray 160. Ball tray 170 may be secured on the recessed area within ridge 166 by an interference fit. Alternatively or additionally, the height of ridge 166 is selected to keep ball tray 170 within the recessed area and to prevent excessive lateral movement of ball tray 17 relative to tray 160 after installation. In one embodiment, ridge 166 is sufficient raised above the upper surface of tray 160 such that ball tray 170 preferably can only be installed by vertical placement from above the recessed area of tray 160, and only be removed from tray 160 by lifting ball tray 170 upwards. There are other ways to removably install ball tray 170 on to tray 160, including those methods described above with respect to inserts 13 and 19 and bases 12 and 18. Alternatively, ball tray 170 may be permanently fixed to tray 160 or may be formed together with tray 160 as a single piece of material.

Figure 7:
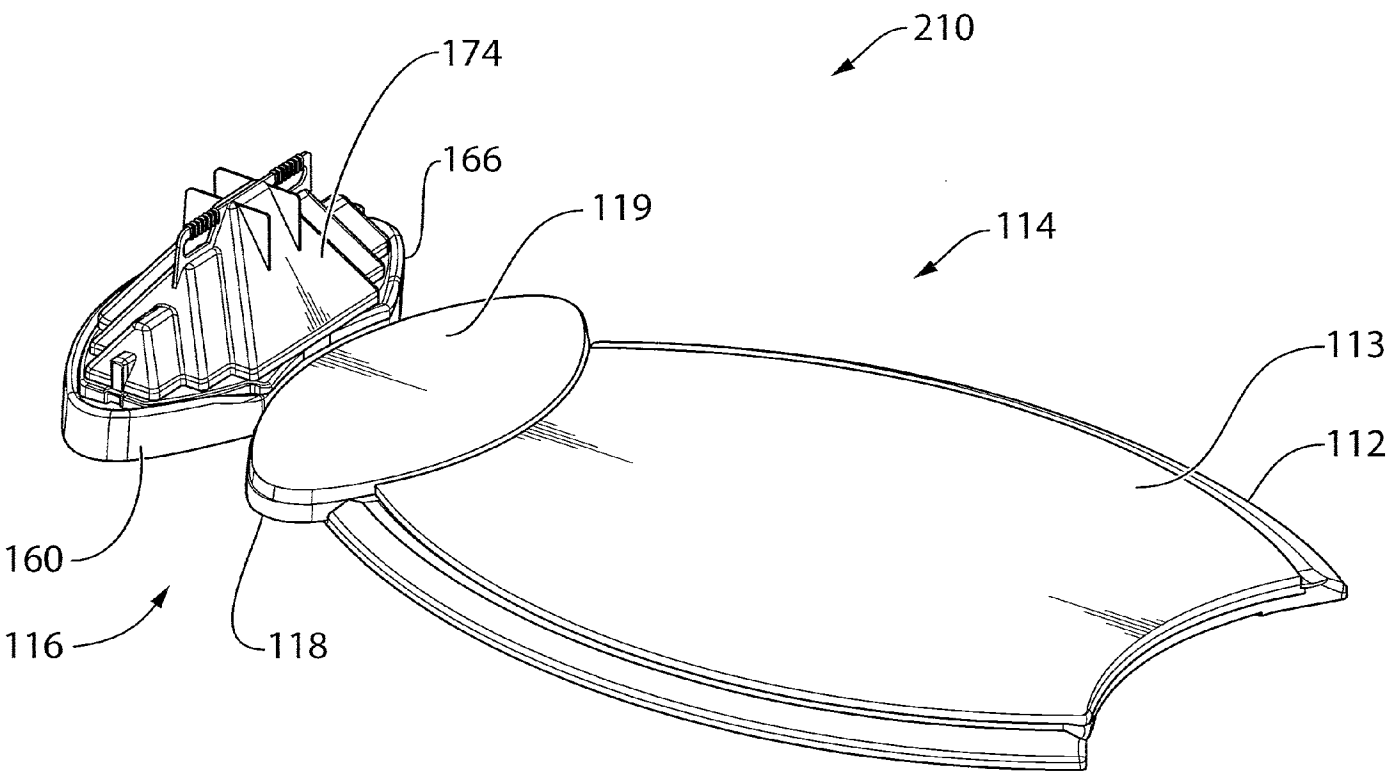
FIG. 7 is a perspective view of still another embodiment of the golf practice mat assembly.

Referring to FIG. 7, golf mat assembly 210 may further include a ball stacking apparatus 174 that allows golf balls to be stacked in a pyramid-like manner on ball tray 170.

The above-described golf mat modules allow for flexible configuration of a golf practice mat assembly and connection of a series of golf practice mat modules and/or assemblies. For example, a golf practice mat assembly comprises a first strike section and a first stance section, connected to each other at a first side and a first end, respectively, in accordance with any of the above-described methods. The first golf practice mat assembly may further comprise a third module, which may be: (i) an additional strike section; (ii)

an additional stance section; or (iii) a tray for golf accessories. The third module may be connected to the second side of the first strike section or the second end of the first stance section, in accordance with any of the above-described methods. The first golf practice mat assembly may comprise further element(s), in additional to the modules mentioned above, including for example a ball tray and a ball stacking apparatus. In assembling the first golf practice mat assembly, and in accordance with the description herein of the various modules, the angle of the width-wise or lengthwise axis of each module relative to that of an adjacent module connected thereto is selectively adjustable.

Figure 8:
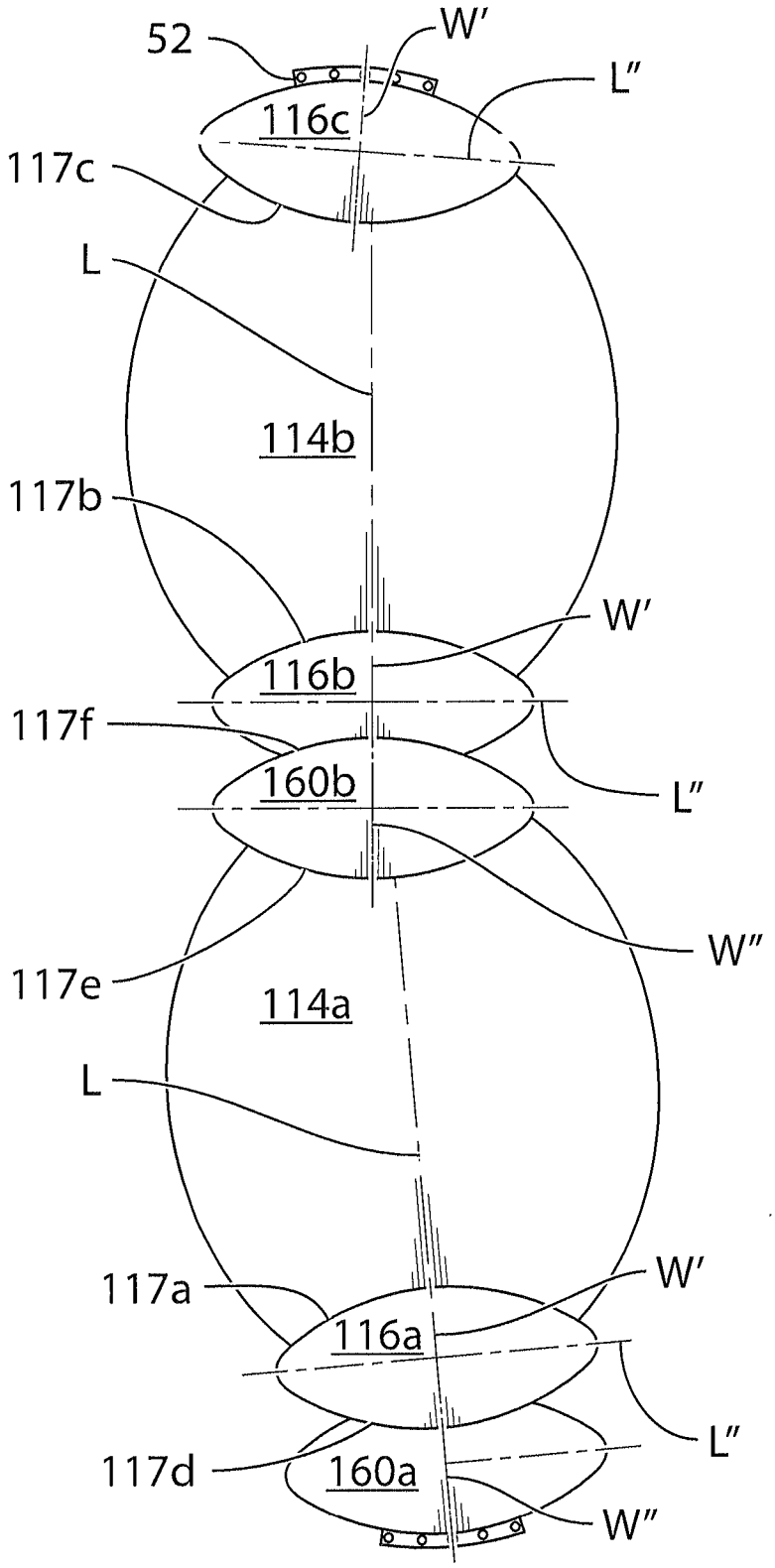
FIG. 8 is a plan schematic view of an expanded golf practice mat assembly.

To create a practise range, the modules may be connected together to form a single mat, such as shown in FIG. 4, and such single mats may be arranged as desired. Alternately, with reference to FIG. 8, a range may be formed of a plurality of connected mats, to create a stable structure and clean appearance. For example, the illustrated range includes two stance sections 114*a*, 114*b* each connected at connections 117*a*, 117*b*, 117*c* to strike sections 116*a*, 116*b*, 116*c*. In fact, stance section 114*b* has a strike section 116*b*, 116*c* connected at each end so that a right or a left handed golfer can use that stance section.

Ball trays 160*a*, 160*b* are also connected into the range through connections 117*d*, 117*e*, 117*f*. One ball tray 160*b* is connected at one side to stance section 114*a* and at the other side to strike section 116*b*.

All connections 117*a*-117*f* are similar including options as noted above and the parts are interchangeable, such that if it is desired to replace tray 160*b* with tray 160*a*, that can be done. Tray 160*a* could also be moved from its illustrated location to connect at end connector 52 of strike section 116*c*. The connections are secure but allow for a selected rotational orientation of one part relative to the other. For example, each connection permits one of a plurality of possible rotational orientations of one part relative to the other part. For example, note that parts 160*a*, 116*a* and 114*a* all have axis W", W' and L in alignment, whereas 117*e* is oriented with axis L of part 114*a* offset, out of alignment with the side to side axis W" of tray 160*b*. Overall the range has a plurality of modules connected securely in a curve such that axis L' of strike sections are angled toward a central point (off the sheet) so that balls hit therefrom tend to be directed toward and collect in a central area.

The present invention allows two or more golf practice mat modules and/or assemblies to be connected. For example, a golf practice mat assembly comprises a first strike section and a first stance section, connected to each other at a first side and a first end, respectively; and a second strike section and a second stance section, connected to each other at a first side and a first end, respectively. A second end of the first stance section is connected to a second side of the second strike section, in accordance with any of the above-described methods. Alternatively, the second end of the first stance section is connected to a second end of the second stance section. As a further alternative, a second side of the first strike section is connected to the second side of the second strike section.

In a further embodiment, the golf practice mat assembly comprises a third strike section and a third stance section, connected to each other at a first side and a first end, respectively. The second side of the third strike section or the second end of the third stance section is connected to a free end or side of one of the first and second stance sections and the first and second strike sections.

In a still further embodiment, one or more additional modules may be added in between any two adjacent modules. For example, a tray may be connected to the second end of the first stance section and the second side of the second strike section. In another sample embodiment, a fourth stance section is connected to and in between the second stance section and the third strike section. Of course, other configurations are possible.

One or more of the modules in the golf mat assembly may be mounted on a frame and/or on a selected underlay.

A method for assembling a golf practice mat assembly is provided, in accordance with the above-described modules. The method comprises: connecting a strike base to a stance base, the sections having features as described above with respect to strike base 18 and stance base 12, wherein the angle between the width-wise axis of the strike base and the lengthwise axis of the stance base is selectively adjustable. The method may further comprise installing a simulated ground insert on the upper surface of the strike base and installing a stance insert on to the stance base. In a further embodiment, the method comprises connecting a third module to either the strike base or the stance base, the third module being one of (i) a strike base; (ii) a stance base; or (iii) a tray for golf accessories, wherein the angle between the width-wise or lengthwise axis of the third module and the axis of the strike base or the stance base is selectively adjustable. The method may still further comprise installing a ball tray on the upper surface of the tray and/or using a ball stacking apparatus to stack golf balls on the ball tray. Further, the method may include mounting one or more of the modules on a frame and/or on a selected underlay.

In so connecting the golf practice mat modules, as described above, the angle of the width-wise or lengthwise axis of each module (i.e. each of the strike sections, the stance sections, and third modules) relative to that of an adjacent module connected thereto is selectively adjustable, such that the modules do not have to be connected in a straight line. Therefore, the configuration of a golf practice mat assembly or a series of interconnecting assemblies to form a practise range, according to the present invention, can be customized as desired and/or to fit a particular space.

The golf practice mat modules and assembly of the present invention are also designed to compartmentalize the components of the golf practice mat to facilitate the transportation and maintenance thereof. The modules, including the inserts, can all be removably connected to one another so each module can be transported and/or sold separately, if desired. Still further, each module can be upgraded and/or substituted independently from the others. Since each module can be replaced independently from the others, the cost of maintaining the mat assembly and/or the amount of waste may be reduced (as compared to a golf practice mat that has to be replaced in its entirety).

Thus, a practise range may be constructed by using a plurality of modules including (i) a plurality of identical strike sections; (ii) a plurality of identical stance sections; and (iii) a plurality of identical trays. The parts (i), (ii) and (iii) can be connected into a curved configuration including a plurality of connected mat assemblies that are each aimed toward a center point, by connecting the parts (i), (ii) and (iii) while selecting the angular orientation of each to the other. In particular, a connector on one part can be connected to a connector on an adjacent part at any one of a plurality of angular orientations.

In a preferred embodiment, the stance base, the stance insert, the strike base, at least part of the simulated ground insert, and/or other modules are formed of molded plastic or an elastomeric substance such as hard rubber, In one embodiment, at least a portion of the mat assembly, for example the upper surface of base 12 or base 18, is thermally formable such that it can be deformed by melting and, when allowed to reset after melting and deformation, durably retains the deformed shape. The thermally formable material allows the upper surface of the base to be heated to its melting point and shaped by applying pressure to the upper surface. The shape achieved by melting and deformation by application of pressure remains when the temperature of the upper surface falls below the melting point.

In order to thermally deform the material of the upper surface, the material is heated to a temperature above its forming temperature, which is often considered its melting temperature. The melting temperatures for thermoformable materials are often well know material characteristics and can, in any event, be readily determined for example by simple testing or contacting the material manufacturer. A temperature may be used wherein the material of the upper surface retains its original form until it has pressure applied thereto. At such a temperature, the material may become highly viscous but formable.

In order to reach these temperatures, the sheet material can be placed in an atmosphere with an elevated temperature such that the deformable material can increase substantially to the selected melting temperature. For example, the sheet material can be placed in a heating oven at a temperature to bring the material to its forming temperature and a die can be pressed thereagainst. Alternately, or in addition, the die can be heated, as by heating it directly or driving the die to convey and emit therefrom thermal energy, and placed into contact with the upper surface of the mat. In so doing, the upper surface of the mat is heat deformed in a shape which is the reverse of the die's outer surface shape, both with respect to the surface relief and perimeter shape, of the die surface. Of course, the rear surface of the sheet material may be supported to hold the sheet material against the pressure of the die.

Thereafter, the heat can be removed to allow the thermally deformed area to cool and thereby set. The heat can be removed by cooling the sheet material (i.e. removing the sheet material from the heated atmosphere), by allowing the die to cool or by removing the hot die from the upper surface. Time is then permitted for the melted mat material to cool and set in its deformed shape.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A golf practice mat assembly comprising:

a stance section with a first end, a second end, positioned opposite the first end, a front lengthwise side extending between the first end and the second end and a second lengthwise side extending between the first end and the second end, the first end includes an edge defining a curved portion extending from a position adjacent the first lengthwise side to a position adjacent the second lengthwise side and having a first radius of curvature;

a strike section including a first side and an opposite side, the first side of the strike section being shaped to define a curved edge and the curved edge has a second radius of curvature selected to be substantially the same as the first radius of curvature;

a connection between the stance section and the strike section, the connection configured to securely and detachably connect the strike section to the stance section and the connection further configured to be angularly selectable and to connect the strike section at one of a plurality of possible angular orientations relative to the stance section;

a ball tray; and a connection structure on the ball tray configured to connect the ball tray and the strike section securely and detachably at one of a plurality of possible angular orientations.

2. The golf practice mat assembly of claim 1 wherein the first end includes an edge shaped to define a concave recess extending from a position adjacent the first lengthwise side to a position adjacent the second lengthwise side and the first side of the strike section is shaped to define a convex edge selected to substantially mate with the concave recess.

3. The golf practice mat assembly of claim 1 wherein the connection includes a plurality of connection points spaced along the first end and a connector on the first side of the strike section and the connector is connectable to any one of the plurality of connection points to thereby connect the strike section to the stance section at one of a plurality of possible angular orientations.

4. The golf practice mat assembly of claim 1 wherein the first end includes an edge shaped to define a concave recess extending from a position adjacent the first lengthwise side to a position adjacent the second lengthwise side and the first side of the strike section is shaped to define a convex edge selected to substantially mate with the concave recess and wherein the connection includes a plurality of connection points spaced along the concave recess and a connector on the first side of the strike section and the connector is connectable to any one of the plurality of connection points to thereby connection the strike section to the stance section at one of a plurality of possible angular orientations.

5. A method for constructing a golf practice range comprising:

positioning a first golf practise mat assembly including a first stance section with a first end, a second end, positioned opposite the first end, and a first lengthwise axis passing through a center point on the first end and the second end; and a first strike section connected to the first stance section;

positioning a second golf practise mat assembly adjacent to the first golf practise mat assembly, the second golf practise mat assembly including a second stance section with a second lengthwise axis passing through opposite ends of the second stance section; and a second strike section connected to the second stance section; and forming a connection between the first golf practise mat assembly and the second golf practise mat assembly by connecting a connector on a curved edge of the first golf practise mat assembly at one possible angular orientation to a mating curved edge on the second golf practise mat assembly such that the first lengthwise axis is angularly offset from the second lengthwise axis, to thereby construct a golf practice range along a curve.

6. The method for constructing a golf practice range of claim 5 further comprising connecting the first golf practise mat assembly and the second golf practise mat assembly with a plurality of additional golf practise mat assemblies.

7. The method for constructing a golf practice range of claim 5 wherein the first golf practise mat assembly includes a first stance section axis orthogonal to the first lengthwise axis and the second golf practise mat assembly includes a second stance section axis orthogonal to the second lengthwise axis and forming a connection includes angling each of the first stance section axis and the second stance section axis toward a central area of the golf practice range before connecting the connector.

8. The method for constructing a golf practice range of claim 5 wherein forming a connection includes connecting the first stance section to the second strike section.

9. The method for constructing a golf practice range of claim 5 wherein the second golf practise mat assembly includes a ball tray connected to the second strike section and wherein forming a connection includes connecting the connector on the curved edge of the first stance section to the mating curved edge on the ball tray.

10. A golf practice mat assembly comprising:

a stance section with a first end, a second end, positioned opposite the first end, a front lengthwise side extending between the first end and the second end and a second lengthwise side extending between the first end and the second end;

a strike section including a first side and an opposite side, the strike section including an upper surface having a raised ridge extending about a recessed area and a simulated grass insert in the recessed area; and a connection between the stance section and the strike section, the connection configured to securely and detachably connect the strike section to the stance section and the connection further configured to be angularly selectable and to connect the strike section at one of a plurality of possible angular orientations relative to the stance section, the connection including a plurality of connection points spaced along the first end and a connector on the first side of the strike section and the connector is connectable to any one of the plurality of connection points to thereby connect the strike section to the stance section at one of a plurality of possible angular orientations.

11. A golf practice mat assembly comprising:

a stance section with a first end, a second end, positioned opposite the first end, a front lengthwise side extending between the first end and the second end and a second lengthwise side extending between the first end and the second end, the first end including a curved edge extending from a position adjacent the first lengthwise side to a position adjacent the second lengthwise side;

a strike section including a first side and an opposite side, the first side being shaped to define an edge curved to substantially mate with the curved edge; and a connection between the stance section and the strike section, the connection including (i) a series of indentations on an underside of either the curved edge of the stance section or the edge of the strike section and (ii) an extension extending from the other of the curved edge or the edge, the extension including a series of raised pegs each raised peg being sized to fit into any one indentation of the series of indentations, the connection configured to securely and detachably connect the series of raised pegs into at least some of the series of indentations and the connection configured to be angularly selectable and to connect the strike section at one of a plurality of possible angular orientations relative to the stance section.

* * * * *